United States Patent [19]

Benson

[11] 4,414,808

[45] Nov. 15, 1983

[54] HYDRAULIC ACTUATOR FOR WELL PUMPS

[75] Inventor: Terrence M. Benson, New Berlin, Wis.

[73] Assignee: Oil & Sales Limited Partnership, Minneapolis, Minn.

[21] Appl. No.: 205,190

[22] Filed: Nov. 10, 1980

[51] Int. Cl.[3] ..... F15B 1/02

[52] U.S. Cl. ..... 60/372; 60/414; 92/108; 417/402

[58] Field of Search ..... 60/372, 414; 92/108; 417/402

[56] References Cited

U.S. PATENT DOCUMENTS

| | | | |
|---|---|---|---|
| 245,101 | 8/1881 | Thayer et al. . | |
| 1,017,722 | 2/1912 | Wintz . | |
| 1,453,293 | 5/1923 | Stephenson . | |
| 2,393,410 | 1/1946 | Pine | 92/108 X |
| 2,556,680 | 6/1951 | Davis . | |
| 2,578,959 | 12/1951 | Yarborough | 60/414 |
| 2,665,551 | 1/1954 | Chenault | 60/414 |
| 2,668,517 | 2/1954 | Craft | 92/108 |
| 2,756,562 | 7/1956 | Deitrickson | 60/372 |
| 2,869,469 | 1/1959 | Williams . | |
| 2,874,641 | 2/1959 | McCandlish et al. . | |
| 2,887,093 | 5/1959 | Jones . | |
| 2,982,100 | 5/1961 | Sinclair | 60/372 |
| 2,990,816 | 7/1961 | Vincent . | |
| 2,996,993 | 8/1961 | Kane | 417/402 |
| 3,052,444 | 9/1962 | Kintner | 92/108 X |

OTHER PUBLICATIONS

Brochure entitled "The Klaeger Pumping Unit", published by Mid-Continent Supply Co.

*Primary Examiner*—Robert G. Nilson
*Attorney, Agent, or Firm*—Merchant, Gould, Smith, Edell, Welter & Schmidt

[57] ABSTRACT

A hydraulic actuator and system for driving a subsurface reciprocating pump. The actuator is double acting and comprises a piston reciprocable in a cylinder on a guide tube, so that the maximum volume of the chamber below the piston is greater than that of the chamber above the piston, and the lower working area of the piston is greater than its upper working area. Ports in the cylinder above and below the piston are connected to a valving and control arrangement, and a source and receiver of hydraulic fluid and an accummulator are also provided. The valving arrangement is controlled so that when the piston reaches a lower level of travel fluid is discharged from the upper chamber to the receive, to enable upward movement of the piston, and when the piston reaches an upper limit of travel discharge of fluid from the upper chamber is interrupted and flow of fluid from the lower chamber to the upper chamber and accummulator is enabled. Several valving and control arrangements are disclosed.

4 Claims, 9 Drawing Figures

133
134
132
131
127
120
M
70
130
126
121
137
136
125
124
71
135
22
123
122

62
242
250
253
252
251
63
247
231
227
233
243
246
230
263
241
244
226
240
245
225
232
257
260
261
90
91
223
262
92
224
216
217
214
234
235
220
254
264
266
265
140
272
270
267
236
215
237
222
221
256
255
271
111
110

HYDRAULIC ACTUATOR FOR WELL PUMPS

TECHNICAL FIELD

This invention relates to the field of hydraulic engineering, and particularly to hydraulic apparatus for operating subsurface reciprocating pumps.

BACKGROUND OF THE INVENTION

One of the problems faced by modern technology is that of delivering to the surface of the earth liquids located in subsurface pockets. It is customary in oil producing areas, for example, to drill a well from the earth's surface to a depth at which it penetrates into a natural reservoir of oil. That depth may be several hundred feet, much too great to permit operation of a simple suction pump, and a lift pump is installed near the bottom of the well, and connected by a string of sucker rods with surface apparatus, called a pumping jack, for causing the pump to reciprocate. Pumping jacks may be either mechanical, such as the familiar walking beam, or may be hydraulic. In either case, the pumping jack must be capable of the considerable stroke required, seven feet for example, and it it must be of sufficient power to move the string of sucker rods and the column of oil rising from the pump to the surface. Twelve thousand pounds may be a reasonable design load for such an apparatus.

Hydraulic pumping jacks of this sort are known, but suffer from certain imperfections. In the first place, a limited quantity of the hydraulic fluid—a liquid—is usually pumped from a reservoir into a hydraulic motor to raise the load, and then allowed to flow back into the reservoir so that the load descends by its own weight. Continuous repetition of this cycle subjects the hydraulic fluid to damage by heating. The arrangement also subjects the mechanical equipment to severe shock each time the direction of movement reverses from upward to downward, and it is further difficult to provide for varying the speed of operation of such equipment.

BRIEF SUMMARY OF THE INVENTION

The present invention comprises a hydraulic pumping jack and system including a hydraulic actuator, an accumulator, a hydraulic supply, and valving and control arrangements, by which the hydraulic fluid is circulated to afford cooling, the shocks at reversal are cushioned, and energy is stored during the descent of the load for use in raising it again. This is in part accomplished by designing the actuator so that its vertically movable piston has a lower working surface of area larger than its upper working surface, and so that a hydraulic chamber including the lower piston surface is of larger volume than a chamber including the upper piston surface. The valving and control arrangements include limit switches determining the range of travel of the piston, and may also include means for varying the speed of operation of the piston in each direction.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing, in which like reference numerals indicate corresponding parts throughout the several views.

DESCRIPTION OF THE PREFERRED EMBODIMENT

Figures 1, 3, 4, 5:
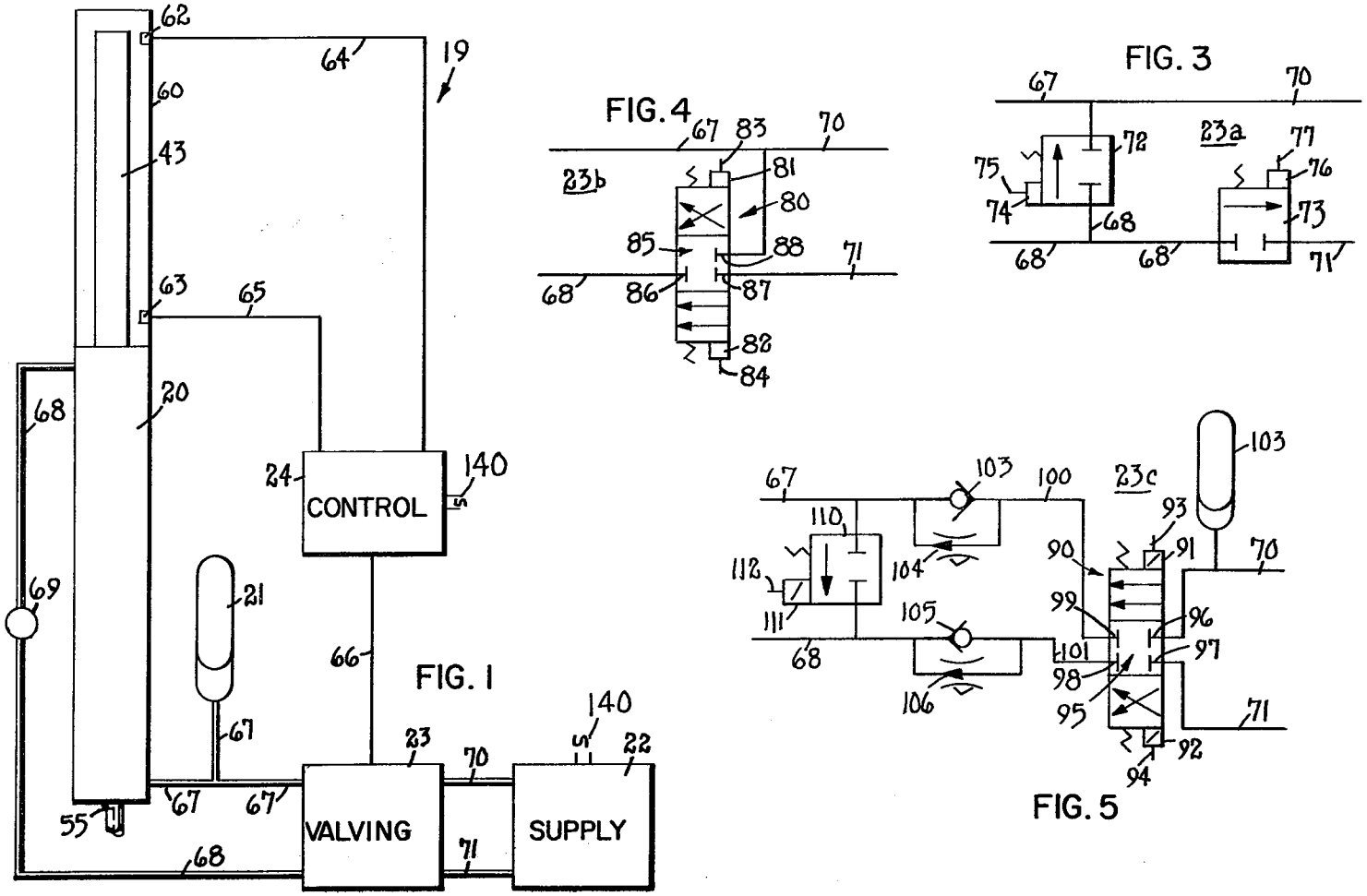
FIG. 1 shows schematically a hydraulic system according to the invention for actuating a subsurface pump not shown.
FIGS. 3, 4, and 5 show several valving arrangements for use in the system of FIG. 1.

FIG. 1 shows a control system 19 according to the invention to comprise a double acting hydraulic actuator 20, an accumulator 21, a hydraulic supply 22, a valving arrangement 23, and a control arrangement 24. Actuator 20 is shown in more detail in FIG. 2, supply 22 is shown in more detail in FIG. 6, embodiments of valving arrangement 23 are shown in more detail in FIGS. 3, 4, and 5, and embodiments of control arrangement 24 are shown in more detail in FIGS. 7–9.

Figure 2:
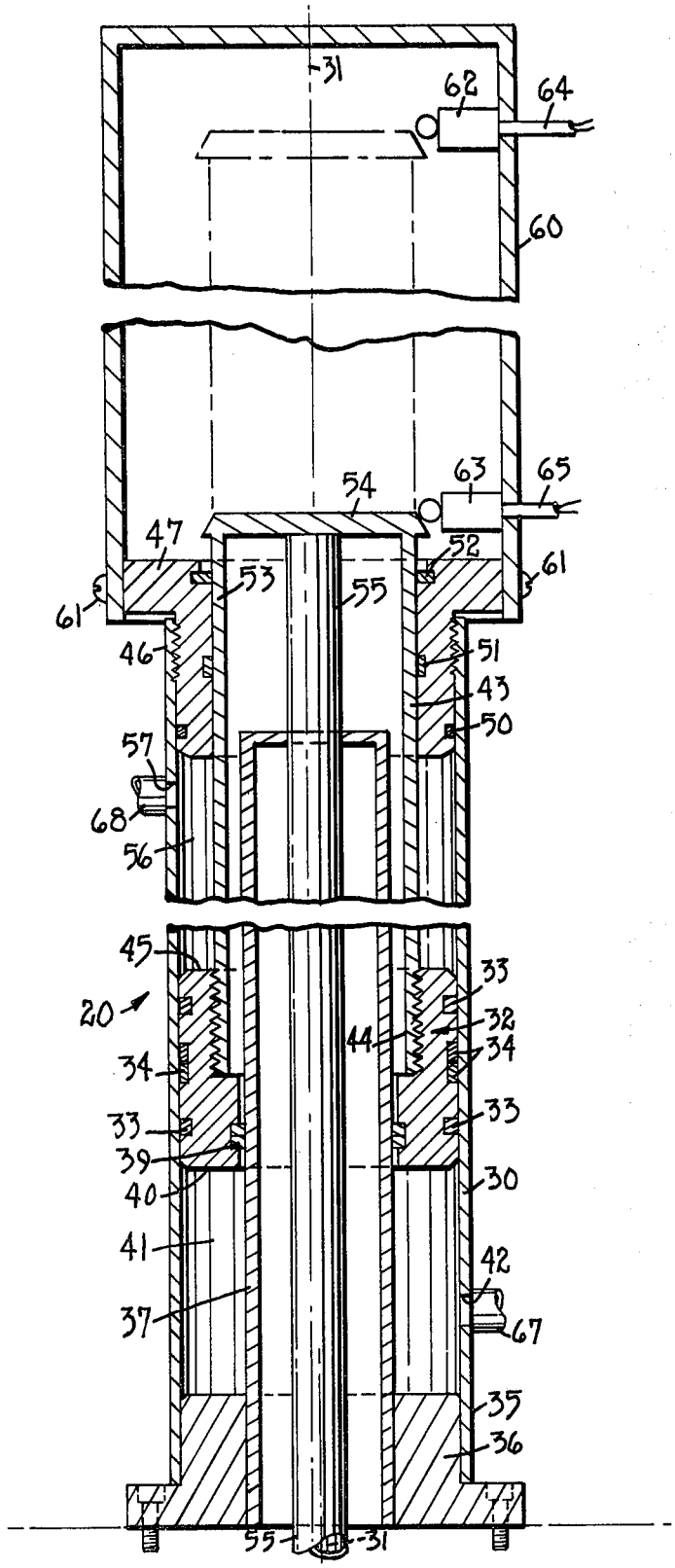
FIG. 2 shows in longitudinal section a linear hydraulic actuator according to the invention.

FIG. 2 shows actuator 20 to comprise a cylinder 39 with a vertical axis 31. A piston 32 is reciprocable in cylinder 30 between upper and lower limits of travel, and includes piston rings 33 and wear rings 34. The bottom end 35 of cylinder 30 is closed by a base plug 36, by which the actuator may be anchored over a subsurface reciprocating pump, not shown, and a guide tube 37 extends coaxially within cylinder 30 from plug 36. Piston 32 slides on tube 37 and is provided with seals 39 which engage tube 37 as the piston moves. The lower surface 40 of the piston, the inner surface of cylinder 30, base plug 36, and the outer surface of guide tube 37 define a first annular hydraulic chamber 41 having a volume which varies, increasing as piston 32 moves upward. A lower port 42 affords communication with chamber 41.

A lift tube 43 has its lower end 44 threaded into the top surface 45 of piston 32 and extends coaxially within cylinder 30 to project upwardly beyond the upper end 46 thereof. Tube 43 moves with piston 32, sliding in a head 47 which is threaded to end 46 and includes an O-ring 50 for outward sealing, and a seal 52 and a wiper 52 for inward sealing. The upper end 53 of tube 43 is closed by a plug 54 from which a lift rod 55 projects downwardly within cylinder 30 through lift tube 43, guide tube 37, and piston 32, to project below end 35 of the cylinder for connection to a string of sucker rods by which the subsurface pump is reciprocated. Head 47, the outer surface of lift tube 43, the upper surface 45 of piston 32, and the inner surface of cylinder 30 define a second annular hydraulic chamber 56 having a volume which varies oppositely to that of chamber 41, decreasing as piston 32 moves upward. The maximum volume of chamber 41 is greater than that of chamber 56, and the working area of surface 45 of piston 32—that between cylinder 30 and lift tube 43—is less than the working area of the bottom surface 40 of the piston. A port 57 affords communication with chamber 56.

An elongated cover 60 is secured on head 47, as by fasteners 61, to protect the upper end of the motor against dirt, dust, water, and physical damage to lift tube 43 when piston 32 is near its upper limit of travel. Cover 60 may be transparent if desired. It is equipped with a pair of limit switches 62 and 63 which form a portion of the control apparatus for the system. These may be microswitches, if physical contact with lift tube 43 is acceptable, or may be magnetically actuated switches if it is preferred to avoid physical contact. Upper switch 62 is normally open, and is located to be closed by lift tube 43 when piston 32 is at the upper limit of its travel. It is connected to control arrangement 24 by a cable 64 (see also FIG. 1). Limit switch 63 is normally closed, and is located to be opened by lift tube 43 when piston 32 is at the lower limit of its travel: it is connected to control arrangement 24 by a second cable 65. A third cable 66 interconnects control arrangement 24 and valving arrangement 23.

Ports 42 and 57 are connected to valving apparatus 23 by conduits 67 and 68 respectively. The former is also connected to accumulator 21, and the latter may include a throttle valve 69 if desired. Hydraulic supply 22 is connected to valving apparatus 23 by conduits 70 and 71.

A simple embodiment 23*a* of valving arrangement 23 is shown in FIG. 3 to comprise first and second electrically operated, normally closed valves 72 and 73. In this arrangement, conduits 67 and 70 are always in communication. When actuator 74 of valve 72 is electrically energized through a cable 75, the valve opens a channel between conduit 68 and conduits 67 and 70. When actuator 76 of valve 73 is electrically energized through a cable 77, the valve opens a channel between conduits 68 and 71. Cables 75 and 77 comprise cable 66 of FIG. 1.

A slightly more complex embodiment 23*b* of valving arrangement 23 is shown in FIG. 4 to comprise a normally centered reversing valve 80 having oppositely acting actuators 81 and 82 electrically energized through cables 83 and 84 to move a spool 85 respectively downward and upward relative to fixed ports 86, 87, and 88 connected to conduits 68, 71, and 67, 70 respectively. In this arrangement also conduits 67, 70 and always in communication. When actuator 81 is electrically energized conduit 71 is isolated and conduit 68 is placed in communication with conduits 67 and 70. When actuator 82 is energized conduit 68 is placed in communication with conduit 71. Here cables 83 and 84 comprise cable 66 of FIG. 1.

A still more versatile embodiment 23*c* of valving arrangement 23 is shown in FIG. 5 to comprise a normally centered reversing valve 90 having oppositely acting actuators 91 and 92 electrically energized through cables 93 and 94 to move a spool 95 respectively downward and upward relative to fixed ports 96, 97, 98, and 99. When actuator 91 is electrically energized, conduit 70 is placed in communication with a conduit 100, and conduit 71 is placed in communication with a conduit 101. When actuator 92 is electrically energized conduit 70 is placed in communication with conduit 101, and conduit 71 is placed in communication with conduit 100. A second accumulator 103 is always connected to conduit 70.

Conduit 100 is connected, through a check valve 103 bypassed by a normally closed throttle valve 104, to conduit 67, and conduit 101 is connected, through a check valve 105 bypassed by a normally closed throttle valve 106, to conduit 68. Valve 103 is oriented to prevent fluid flow from conduit 67 to conduit 100, and valve 105 is oriented to prevent fluid flow from conduit 101 to conduit 68. A normally closed valve 110 has an actuator 111 energizable through a cable 112: upon energization, valve 110 opens a channel between conduits 67 and 68. Cables 93, 94, and 112 comprise cable 66 of FIG. 1.

Figure 6:
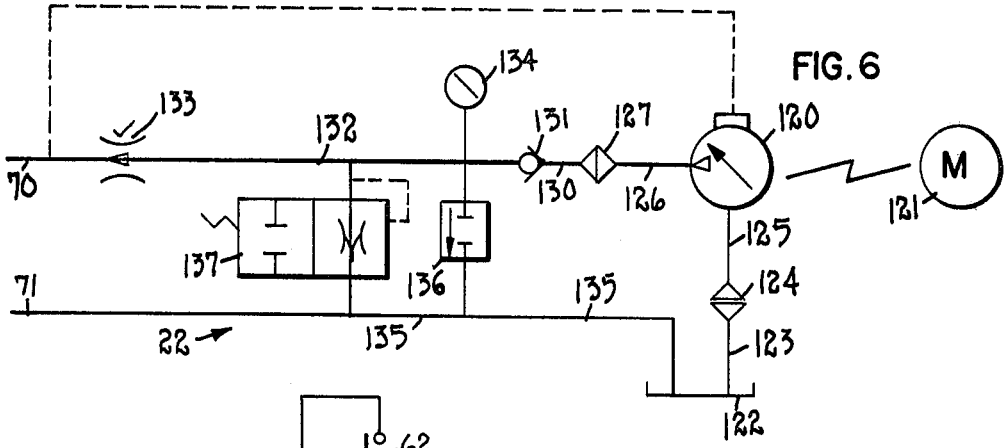
FIG. 6 shows a hydraulic supply suitable for use in the system of FIG. 1.

Hydraulic supply 22 is shown in FIG. 6 to comprise a pressure compensated variable displacement pump 120 driven by an electric motor 121 to draw fluid from a receiver 122 through a conduit 123, a suction screen 124 and a conduit 125, and deliver it through a conduit 126, a filter 127, a conduit 130, a check valve 131, a conduit 132, and a throttle valve 133 to conduit 70, a pressure gauge 134 being provided. Conduit 71 is extended at 135 to discharge fluid to receiver 122. A relief valve 136 is connected between conduits 132 and 135, as is a starting valve 137.

Figure 7:
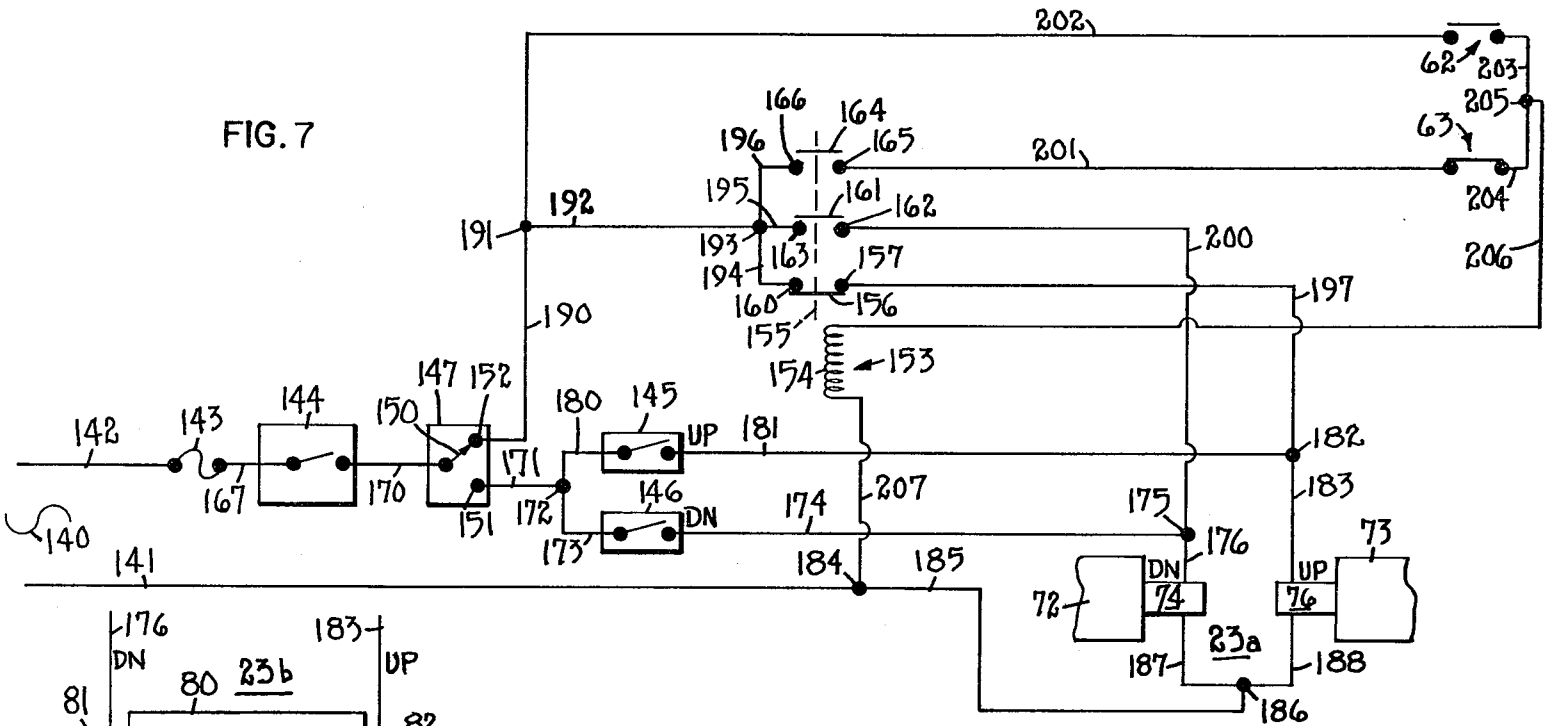
FIG. 7 shows an electrical schematic for the system of FIG. 1 using the valving arrangement of FIG. 3.

An embodiment of control apparatus 24 is shown in FIG. 7 to be energized from a source 140 of alternating voltage by a pair of conductors 141 and 142, the former being the common or ground conductor. In addition to limit switches 62 and 63, the apparatus includes a fuse 143, single pole single throw switches 144, 145, and 146, a single pole double throw switch 147 having a switching contact 150 and two fixed contacts 151 and 152, and a relay 153 including a winding 154 which actuates an armature 155 to displace a first movable contact 156 out of normal engagement with fixed contacts 157 and 160, to displace a second movable contact 161 into engagement with fixed contacts 162 and 163, and to displace a third movable contact 164 into engagement with fixed contacts 165 and 166. In this figure, the valving arrangement of FIG. 3 is shown schematically.

A circuit may be traced in FIG. 7 from conductor 142 through fuse 143, conductor 167, switch 144, conductor 170, switch contacts 150 and 151, and conductor 171 to a junction point 172, from which a first circuit extends through conductor 173, switch 146, conductor 174, junction point 175, and conductor 176 to actuator 74 of valving arrangement 23*a*, and from which a second circuit extends through conductor 180, switch 145, conductor 181, junction point 182, and conductor 183 to actuator 76 of valving arrangement 23*a*. Conductor 141 is connected through junction point 184, conductor 185, junction point 186, and conductors 187 and 188 to actuators 74 and 76.

A circuit may be traced from contact 152 of switch 147 through conductor 190, junction point 191 and conductor 192 to junction point 193, which is connected by conductors 194, 195, and 196 to relay contacts 160, 163, and 166. Relay contact 157 is connected by conductor 197 to junction point 182. Relay contact 162 is connected by conductor 200 to junction point 175. Relay contact 165 is connected by conductor 201 to one contact of normally closed limit switch 63, and junction point 191 is connected by conductor 202 to one contact of normally open limit switch 62. The other contacts of the limit switches are connected by conductors 203 and 204 to a junction point 205, which is connected by a conductor 206 to one terminal of relay winding 154. The other terminal of the relay winding is connected by conductor 207 to junction point 184.

Figure 8:
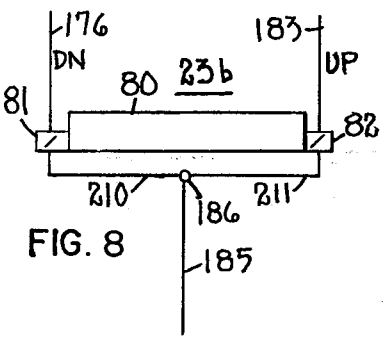
FIG. 8 is a fragmentary showing of a modification of FIG. 7 using the valving arrangement of FIG. 4.

FIG. 8 shows the specific connections of the control apparatus to the valving arrangement 23*b* of FIG. 5. Conductors 176 and 183 are connected to first terminals of actuators 81 and 82, and the other actuator terminals are connected by conductors 210 and 211 to junction point 186. Conductors 176 and 210 comprise cable 83 of FIG. 4, and conductors 183 and 211 comprise cable 84 of FIG. 4.

Figure 9:
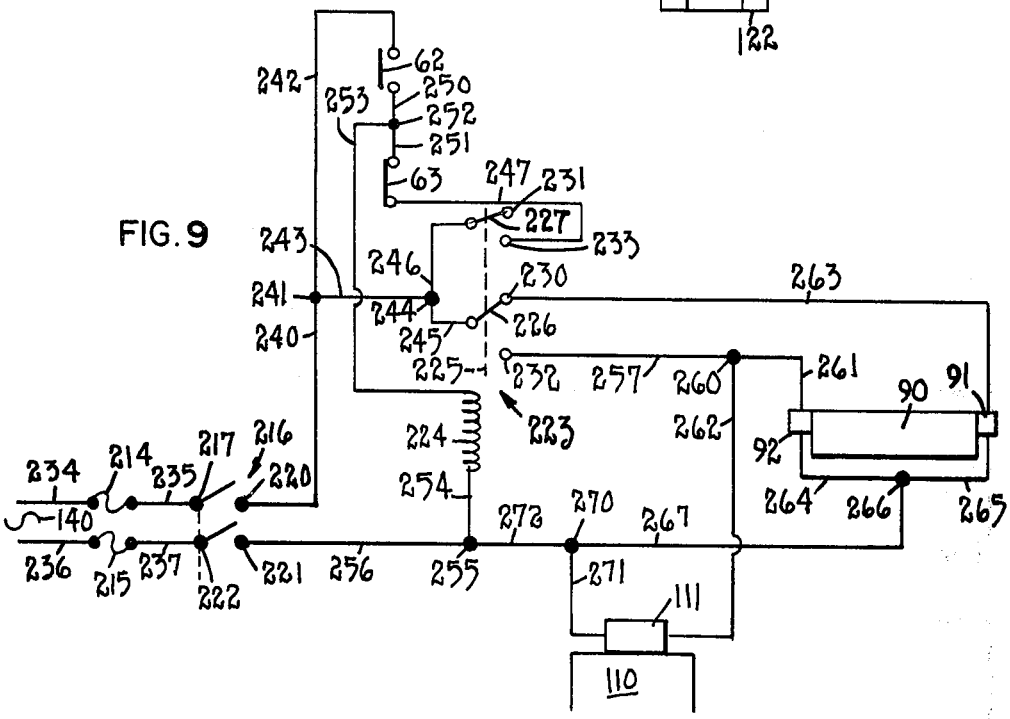
FIG. 9 shows a simplified electrical schematic using the valving arrangement of FIG. 5.

FIG. 9 shows a simplified electrical schematic, applied to the valving arrangement 23*c* of FIG. 5. In addition to limit switches 62 and 63, the components are a pair of fuses 214 and 215, a power switch 216 having terminals 217, 220, 221 and 222 and a relay 223 having a winding 224 moving an armature 225 to displace movable contacts 226 and 227 out of normal engagement with fixed contacts 230 and 231 and into engagement with fixed contacts 232 and 233.

Power is supplied from source 140 to switch contacts 217 and 222 through conductor 234, fuse 214, and conductor 235, and through conductor 236, fuse 215, and conductor 237 respectively. Terminal 220 is connected through conductor 240, junction point 241, and conductor 242 to one contact of normally open limit switch 62, and from junction point 241 through conductor 243, junction point 244, and conductors 245 and 246 to relay contacts 226 and 227 respectively.

Relay contact 233 is connected by a conductor 247 to one contact of normally closed limit switch 63. The other contacts of switches 62 and 63 are connected through conductors 250 and 251, junction point 252, and conductor 253 to one terminal of relay winding 224, the other terminal of which is connected through conductor 254, junction point 255 and conductor 256 to switch contact 221.

Relay contact 232 is connected by conductor 257, junction point 260, and conductors 261 and 262 to valve actuators 92 and 111 respectively. Relay contact 230 is connected by conductor 263 to valve actuator 91. The actuator circuits are completed through conductors 264 and 265, junction point 266, and conductor 267, and through conductor 271, to junction point 270, the latter being connected by conductor 272 to junction point 255.

In one embodiment of the invention the range of travel of piston 32 is 85 inches, which requires the addition of 4.6 gallons of hydraulic fluid at port 42. The area of the lower surface 40 of piston 32 is 12.57 square inches, so that with a hydraulic pressure of 1,000 psi a load of more than 12,000 pounds can be lifted. The area of the upper surface 45 of piston 32 is 7.08 square inches, and the maximum volume of chamber 56 is about $\frac{1}{3}$ of the maximum volume of chamber 41. The size of accumulator 21 if used alone is 10 gallons: if used with a second accumulator 103 their sizes may be 5 gallons and 4 gallons. Pump 121 may have a rating of 15 gallons per minute at at maximum pressure of 2500 pounds per square inch.

OPERATION OF THE PREFERRED EMBODIMENTS

The operation of my system is as follows, referring generally to FIG. 1 and specifically to FIGS. 2, 6, and 7. Switches 144, 145, and 146 are open. Switch 147 is in its "AUTOMATIC" position, in which contact 150 engages contact 152. Motor 121 is driving pump 120, and hydraulic fluid at a pressure determined by relief valve 136, for example 1000 pounds per square inch, is available at conduit 70, being indicated at gauge 134 and regulated by relief valve 136. Piston 32 is at some position within its range of travel, so that switch 62 is open and switch 63 is closed. Lift rod 55 is connected to the sucker rods for operating the subsurface pump. Valves 72 and 73 are closed so that the position of piston 32 in cylinder 30 is hydraulically fixed.

To put the system in operation, switch 144 is closed. This completes a circuit from conductor 142 through fuse 143, conductor 167, switch 144, conductor 170, switch contacts 150 and 152, conductor 190, junction point 191, conductor 192, junction point 193, conductor 194, relay contacts 160, 156, 157, conductor 197, junction point 182, and conductor 183 to actuator 76 of valve 73, the circuit being completed through conductor 188, junction point 186, conductor 185, and junction point 184 to conductor 141. Valve 73 opens, so that fluid can flow out of chamber 56 through conduit 68, and fluid from the pump may enter chamber 41 and displace piston 32 upwards, to raise lift tube 43 and lift tube 43 and lift rod 55, the fluid above piston 32 passing through conduit 68, valve 73, and conduit 71 to receiver 122.

When actuator 20 reaches the top of its stroke, switch 62 is closed, completing a circuit from junction point 191 through conductor 202, switch 62, conductor 203, junction point 205, conductor 206, relay winding 154, conductor 207, and junction point 184 to conductor 141. Relay 153 operates, completing its own holding circuit through contacts 161–3 and switch 63, interrupting at its contacts 160, 156, 157 the circuit for valve 73, which closes, and completing a circuit for actuator 74 of valve 72 through conductor 176, junction point 175, and conductor 200 from relay contact 162, so that valve 72 now opens. This means that the pressures on surfaces 40 and 45 of piston 32 are made equal, that on surface 40 still acting to lift the piston but that on surface 45 now acting in opposition, to lower the piston. The lifting force is no longer sufficient to support the weight of the load on lift rod 55, which according acts through piston 32 to drive liquid out of chamber 41 through conduit 67, valve 72, and conduit 68 into chamber 56, the rate of fluid flow and hence the rate of descent of the piston being adjustable by adjusting valve 69. Back flow of the liquid from conduits 67 and 70 to supply 22 is prevented by check valve 131.

Because the volume of chamber 56 is less than that of chamber 41, a downward movement of piston 32 is accompanied by exit of a greater volume of liquid at port 42 than can be received at port 57. This excess flows into accumulator 21, the energy for the resulting increase in pressure, at both surfaces of the piston, being derived from the weight of the descending pump string.

When piston 52 reaches its lower level of travel, switch 63 opens the circuit for relay winding 154, and the relay is deenergized, interrupting at contact 161 the circuit for actuator 74 of valve 72, which closes, and completing at contact 156 the circuit for actuator 76 of valve 73, which now opens. The hydraulic chambers are now isolated, chamber 56 being free to empty through valve 73, and liquid flowing from accumulator 21 through conduit 67 into chamber 41 to raise piston 32. Discharge of liquid from the accumulator lowers the pressure in conduit 67 to the output pressure of pump 120, which now continues to supply liquid to conduit 67 and raise piston 32. Upward movement of the piston allows switch 63 to close, but the relay winding circuit has been opened at contacts 164, 165, 166, and no change in the system occurs at this time. When the piston rises to cause closure of switch 62 a cycle of operation has been completed, and the cycle is repeated as long as switches 144 and 152 remain as described.

Opening of switch 144 deenergizes whichever of actuators 74 and 76 is currently energized, closing both valves and locking the piston in its then position. Reclosing switch 144 restarts the cycle in its upward direction, regardless of what direction it was moving in when shut off.

It is sometimes desirable, in setup and adjustment operations, to be able to cause movement of the piston in a desired sense for a short distance. To accomplish this, switch 147 is thrown into its "MANUAL" position, in which contact 150 engages contact 151. Now it it is desired to raise the piston, switch 145 is manually closed, completing an energizing circuit for actuator 76 from source 140 through conductor 142, fuse 143, conductor 167, switch 144, conductor 170, switch contacts 150 and 151, conductor 171, junction point 172, conductor 180, switch 145, conductor 181, junction point 182, and conductor 183. Valve 73 opens, allowing liquid to pass from chamber 56 through outlet 68, so that pump pressure can act in chamber 41 to raise the piston. Opening of switch 145 terminates this operation.

In the same way, when it is desired to lower piston 32 slightly, switch 147 is placed in its "MANUAL" position and switch 146 is closed, completing an energizing circuit for actuator 74 from source 140 through conductor 142, fuse 143, conductor 167, switch 144, conductor 170, switch contacts 150 and 151, conductor 171, junction point 172, conductor 173, switch 146, conductor 174, junction point 175, and conductor 176. Valve 72 opens, equalizing the pressures on the top and bottom of the piston, and allowing the load to lower the piston. Opening of switch 145 terminates this operation.

Operation of the system using the valving arrangement of FIG. 4 will now be explained, referring also to FIGS. 1, 7, and 8. Valve 80 is normally in center position, in which conduit 68 is isolated so that the piston is hydraulically locked in position. With switch 47 in its "AUTOMATIC" position, closure of switch 144 completes the circuit to conductor 183 described above, energizing actuator 82 of the valve. This raises spool 85 to complete a passage between conduits 68 and 71, enabling flow of fluid from chamber 56 and thus enabling flow of fluid into chamber 41 to raise the piston. Operation of switch 62 acts on relay 153 as described above to deenergize conductor 183, and energize conductor 176. Spool 85 is now lowered past its central position, placing conduit 68 in communication with conduits 67 and 70 to allow fluid passage from chamber 41 to chamber 56 and permit descent of the piston and admission of fluid into accumulator 21 as before. When switch 63 opens, relay 153 is deenergized to deenergize conductor 176 and energize conductor 183, so that the cycle of operation is repeated. Opening of switch 144 centers spool 85 and hence locks the piston in position hydraulically.

In the "MANUAL" position of switch 147, operation of "UP" switch 145 or "DOWN" switch 146 acts to energize conductor 183 or conductor 176 as before, acting through actuator 82 or actuator 81 to cause valve spool displacement and resulting piston movement. It will be apparent that valve 80 of FIG. 4 is the functional equivalent of valves 72 and 73 of FIG. 3.

The operation will now be described of a system using valving arrangement 23*c* of FIG. 5 and the control arrangement of FIG. 9, FIGS. 1, 2, and 6 also being pertinent.

Switch 216 is open. Motor 121 is driving pump 120 and hydraulic fluid at a pressure determined by relief valve 136 is available in conduit 70 as before. Piston 32 is at some position within its range of travel, so that switch 62 is open and switch 63 is closed. Lift rod 55 is connected to a load, relay 223 is not energized, valve 90 is centered, and valve 110 is closed.

To put the system in operation switch 216 is closed. This completes a circuit from source 140 through conductor 234, fuse 214, conductor 235, switch contacts 217 and 220, conductor 240, junction point 241, conductor 243, junction point 244, conductor 245, relay contacts 226 and 230, and conductor 163 to actuator 91 of valve 90, the circuit being completed by conductor 265, junction point 266, conductor 267, junction point 270, conductor 272, junction point 255, conductor 256, switch contacts 221 and 222, conductor 237, fuse 215, and conductor 253 to source 140. Valve 90 operates, completing passages from conduit 70 to conduit 100 and from conduit 71 to conduit 101. Valve 110 remains closed. Fluid flows from conduit 100 through valve 103 to conduit 67, to enter chamber 41 and move piston 32 upward, fluid flowing out of chamber 56 through conduit 68 and valve 105 to conduit 101.

When switch 62 closes a circuit is completed from junction point 241 through conductor 242, switch 62, conductor 250, junction point 252, and conductor 253 to relay winding 224, the circuit being completed through conductor 254 to junction point 255. Relay 223 operates, interrupting at contacts 226 and 230 the energizing circuit for valve actuator 91 and completing at contacts 226 and 232 circuits which may be traced through conductor 257 to junction point 260 and thence by conductors 261 and 262 to valve actuators 92 and 111. Valve 110 operates to interconnect conduits 68, 101, with conduits 67, 100, and valve 90 operates past its center position to connect conduit 70 with conduit 101 and to connect conduit 71 with conduit 100. However, by reason of check valves 103 and 105 no fluid flow from pump 120 or to receiver 122 takes place. At the same time valve 112 operates to interconnect conduits 68, 101 with conduits 67, 100, and the load on rod 55 acts as previously described to force fluid from chamber 41 into chamber 56 and accumulator 21.

Operation of relay 223 also completes a holding circuit for the relay from junction point 241 through conductor 243, junction point 244, conductor 246, relay contacts 227 and 233, conductor 247, switch 63, and conductor 251 to junction point 252, whereby to maintain relay operation when the piston moves downward and switch 62 opens.

When switch 63 is opened, at the bottom of the piston travel, the holding circuit for relay 223 just traced is interrupted, and the relay is deenergized, the circuit to actuators 92 and 111 is opened at relay contacts 226 and 232, and valve 110 closes. However, the circuit for actuator 91 of valve 90 is again completed at relay contacts 226 and 230, and valve 90 returns to a state enabling upward piston movement, so that the cycle can continue.

If it is desired to move piston 32 manually, switch 216 is turned off but pump operation is continued, and valves 103 and 105 are open to the desired extent. Valve 90 is manually operable, and for up movement of piston 32 valve 90 is operated manually to lower spool 95 with respect to ports 96–99, admitting fluid to conduit 67 through valve 104 and conduit 100 from conduit 70, and enabling flow of fluid from conduit 68 through valve 106 and conduit 101 to conduit 71, so that piston 32 is raised. If it is desired to lower piston 32 manually, the same procedure is followed, except that valve 90 is operated manually in the opposite sense, fluid from conduit 70 flowing through conduit 101, valve 106, and conduit 68 to the top of the cylinder, and fluid from the bottom of the cylinder flowing through conduit 67, valve 104, and conduit 100 to conduit 71. In each case after manual operation has been completed valve 90 is allowed to center itself, and valves 104 and 106 are again closed.

The presence of accumulator 103 enables the use of an accumulator of smaller size at 21, and also enables the use of a pump 121 of smaller volume rating.

From the foregoing it will be evident that the invention comprises a specially designed hydraulic actuator having chambers of different volumes and piston surfaces of different areas, in combination with valving means directing the flow of hydraulic fluid to and from the actuator chambers and to and from a hydraulic actuator associated therewith.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. Hydraulic apparatus for actuating a subsurface reciprocating pump, comprising, in combination:

I. a hydraulic actuator comprising, (a) a vertically disposed motor cylinder having first and second ends, (b) a guide tube coaxial within said cylinder and extending from said second end thereof along a major portion of the length thereof, (c) means mounting said guide tube at said second end of said cylinder and closing the space between said cylinder and said tube, so that said cylinder and said guide tube define a first annular hydraulic chamber, (d) an annular piston, having first and second surfaces, reciprocable along said tube in said cylinder between first and second limits of travel, to vary the volume of said first chamber, (e) an elongted lift tube within said cylinder and surrounding said guide tube, having a first end extending beyond said first end of said cylinder in sealing relation thereto and a second end secured to said first surface of said piston, to reciprocate with said piston in said cylinder and define with said cylinder a second annular hydraulic chamber of which the volume varies, with movement of said piston, oppositely to the variation in volume of said first chamber, (f) a lift rod secured to said first end of said lift tube and extending through said lift tube and said guide tube beyond said second ends thereof for connection to the pump rod of a subsurface pump, and (g) first and second port means affording communication to said first and second chambers respectively, at sites beyond the limits of travel of said piston;

II. a hydraulic accummulator connected to said first port means;

III. a continuous source of hydraulic fluid under pressure;

IV. a receiver for hydraulic fluid;

V. control means actuated when said piston moves to said limits of its travel; and VI. valvable means interconnecting said actuator, said accumulator, said pump, and said receiver so as to cause reciprocation of said piston, lift tube and lift rod in said cylinder, to cause continuous circulation of fluid for said actuator from and to said source, to repetitively store and release in said accummulator energy derived from the downward movement of a mass connected to said lift rod, and to cushion the reverse of said motor at the first limit of travel of the piston, said valvable means including (a) first valvable means for interconnecting said port means, (b) second valvable means for connecting said second port means with said receiver, (c) means connecting said accumulator and said second port means to said source, and (d) means enabling actuation of said valvable means by said control means.

2. Hydraulic apparatus for actuating a subsurface reciprocating pump, comprising, in combination:

I. a hydraulic actuator comprising, (a) a vertically disposed motor cylinder having upper and lower ends, (b) means, including a piston reciprocable in said cylinder dividing said cylinder into upper and lower closed chambers, the volumes of said chambers varying oppositely with movement of said piston, said piston having a lower working surface of area larger than its upper working surface so that said lower chamber is of larger volume than said upper chamber, (c) a lift rod actuated by said piston, and (d) upper and lower ports affording communication with said upper and lower chambers;

II. a hydraulic accumulator;

III. a source of hydraulic fluid under pressure including a pump and a receiver; and IV. valving means operable between a first condition, in which fluid ingress from said pump is enabled to said lower port and said accumulator, and fluid egress to said receiver is enabled from said upper port, and a second condition in which said fluid egress to said receiver is prevented and fluid flow from said lower port and said pump to said accumulator and said upper port is enabled; and V. said piston being reciprocable through a range between upper and lower limits of travel, and means effective when said piston reaches said levels of travel to actuate said valving means between said first and second conditions, whereby to reverse the direction of movement of said piston.

3. In combination, apparatus for vertically reciprocating a load, comprising:

a hydraulic actuator including a cylinder and a piston moving vertically in said cylinder between upper and lower limits of travel, and first and second ports communicating with lower and upper closed chambers in said cylinder below and above said piston respectively, said piston having a lower working surface of area larger than its upper working surface so that said lower chamber is of larger volume than said upper chamber;

means for connecting said load to said piston;

a hydraulic accumulator;

means for connecting said first port and said accumulator to a source of hydraulic fluid under pressure;

means including a first normally closed valve for connecting said second port to a receiver for hydraulic fluid;

means including a second normally closed valve for connecting said second port to said accumulator and said first port; and control means acting when said piston reaches said lower limit of travel to open said first valve and close said second valve to reverse the direction of movement of said piston, and acting when said piston reaches said upper level of travel to close said first valve and open said second valve to reverse the direction of travel of said piston and store fluid under pressure in said accumulator.

4. In combination:

a hydraulic actuator for vertically reciprocating a load including a cylinder and a piston moving vertically in said cylinder between upper and lower limits of travel, and first and second ports communicating with lower and upper closed chambers in said cylinder below and above said piston, respectively, said piston having a lower working surface of area larger than its upper working surface so that said lower chamber is of larger volume than said upper chamber;

a hydraulic accumulator;

means for connecting said first port and said accumulator to a source of hydraulic fluid under pressure;

a receiver for hydraulic fluid; and valving means connected to said ports and said receiver and having a first condition, in which fluid flowing from said second port to said receiver is enabled to raise said piston, and a second condition, in which said flow to said receiver is prevented and said second port is connected to said first port and said accumulator, to lower said piston and charge said accumulator.

* * * * *

UNITED STATES PATENT AND TRADEMARK OFFICE

CERTIFICATE OF CORRECTION

PATENT NO. : 4,414,808

DATED : November 15, 1983

INVENTOR(S) : Terrence M. Benson

It is certified that error appears in the above-identified patent and that said Letters Patent is hereby corrected as shown below:

On the title page

In the Abstract, line 13, "receive" should be --receiver--.

In the Abstract, lines 10 and 18, "accummulator" should be --accumulator--.

Column 2, line 33, "39" should be --30--.

Column 2, line 54, "seal 52" should be --seal 51--.

Column 3, line 46, "and" should be --are--.

Column 8, line 53, after "111", insert --is deenergized, the circuit to actuators 92 and 111--.

Column 9, line 48, "elongted" should be --elongated--.

Signed and Sealed this

*Eighth* Day of *May 1984*

[SEAL]

*Attest:*

GERALD J. MOSSINGHOFF

*Attesting Officer*

*Commissioner of Patents and Trademarks*